United States Patent [19]

McRee, Jr.

[11] 4,356,778

[45] Nov. 2, 1982

[54] UNDERFIRE AIR AND STEAM SYSTEM AND INCINERATING PROCESS FOR A CONTROLLED STARVED-AIR INCINERATOR

[75] Inventor: Robert E. McRee, Jr., Charlotte, N.C.

[73] Assignee: Environmental Control Products, Inc., Charlotte, N.C.

[21] Appl. No.: 204,490

[22] Filed: Nov. 6, 1980

[51] Int. Cl.[2] ..... B09B 3/00; F23G 7/00

[52] U.S. Cl. ..... 110/244; 110/248; 110/212; 110/234

[58] Field of Search ..... 110/280–284, 110/289–291, 295, 297, 306, 244, 248, 210, 234

[56] References Cited

U.S. PATENT DOCUMENTS

| | | | |
|---|---|---|---|
| 1,159,862 | 11/1915 | Ostergren | 110/291 |
| 3,595,181 | 7/1971 | Anderson | 110/190 |
| 3,722,433 | 3/1973 | Kramer | 110/238 |
| 3,785,304 | 1/1974 | Stookey | 110/190 |
| 4,033,725 | 7/1977 | Reed et al. | 110/212 |
| 4,109,590 | 8/1978 | Mansfield | 110/244 |

*Primary Examiner*—Henry C. Yuen

*Attorney, Agent, or Firm*—Bell, Seltzer, Park & Gibson

[57] ABSTRACT

An underfire system for a controlled starved-air incinerator and incinerating process which minimizes high localized temperatures in the main combustion chamber to lessen clinker formation and vaporization of inorganics for minimizing the particulate emission rate and which maximizes conversion of the fixed carbon portion of the waste materials into volatile matter for maximizing the thermal efficiency of the incinerator. The underfire system supplies air at less-than-stoichiometric requirements which creates an exothermic reaction between some of the fixed carbon in the waste material and the oxygen in the air to produce volatile carbon dioxide. In addition, steam is supplied to the burning waste materials, preferably alternately with the air supply, for creating an endothermic "water-gas reaction" between additional fixed carbon in the waste material and the steam to produce volatile carbon monoxide and hydrogen gas and for absorbing undesired heat from the exothermic reaction.

2 Claims, 8 Drawing Figures

UNDERFIRE AIR AND STEAM SYSTEM AND INCINERATING PROCESS FOR A CONTROLLED STARVED-AIR INCINERATOR

FIELD OF THE INVENTION

This invention relates to an underfire air and steam system in a controlled starved-air incinerator and process of incinerating waste materials for increasing thermal efficiency and minimizing clinker formation and particulate emission from the incinerator.

BACKGROUND OF THE INVENTION

Processes of incinerating waste materials and controlled incinerators of the so-called "starved-air" type have been well developed over the past decade for incinerating a wide variety of waste material with extremely low particulate emission. These incinerators are often connected with waste heat recovery systems in the form of steam boilers or the like for utilizing the hot combustion gases for recovering heat produced during incineration. Most waste materials which would be incinerated can be basically described as being composed primarily of (1) volatile matter, (2) moisture, (3) fixed carbon and (4) non-combustibles (ash or inert residue).

In these controlled starved-air incinerators and processes, the waste is initially burned in a main combustion chamber through the use of an underfire system supplying air to support combustion at less-than-stoichiometric requirements or theoretical air required for complete combustion of the waste materials which results in very slow burning at low temperatures. This, in effect, acts like distillation whereby the volatile matter and moisture are vaporized and a portion of the fixed carbon is converted to vaporized volatile matter, all of which pass to a secondary combustion chamber. This slow burning at low temperatures in the main combustion chamber is necessary to reduce turbulence created during this intitial burning to minimize non-combustible particles from passing with the vapors into the secondary combustion chamber and to prevent vaporization of some of the inorganic substances in the non-combustibles, which may result in stack opacity problems and particulate emission rates which are higher than permissible under many current state and federal environmental laws. Additionally, slow burning at low temperatures in the main combustion chamber is desirable for lessening clinker formation resulting from ash fusion and melting of certain inorganic materials, such as low melting point metals, glass, etc.

The vaporized volatile materials are thereafter burned in the secondary combustion chamber under greater-than-stoichiometric conditions, thereby effecting substantially complete combustion of such vapors and conversion to organic materials for emitting to the atmosphere. The non-combustible inert residue or ash is then removed from the main combustion chamber of the incinerator for disposal in landfills or the like.

Notwithstanding the attempts to effect burning in the main combustion chamber at low temperatures by an underfire air system which supplies air at less-than-stoichiometric requirements for the waste materials, most prior incinerators and processes have suffered from problems with localized high temperatures around the individual underfire air supply manifolds or pipes. In these localities, the air may be greater-than-stoichiometric with respect to waste materials in that immediate vicinity resulting in the above-described problems occurring of undesirable clinker formation and vaporization of non-combustibles which results in higher than desirable particulate emission from the incinerator.

An additional problem has been presented in such prior controlled starved-air incinerators and processes, in that, due to the very nature of less-than-stoichiometric burning in the main combustion chamber, a significant portion of the fixed carbon in the waste materials is not converted to volatile matter and exits the incinerator as partially burned char in the non-combustible inert residue or ash. This creates a problem in that many states will not accept such residue in their landfills if the residue has more than a certain level of residual combustibles therein. Many pathogenic wastes and other hazardous wastes must have maximum burning of the volatile materials therein. Additionally, the incomplete combustion of fixed carbon in the waste materials results in a loss of overall thermal efficiency of the incinerator which becomes of significant importance when the incinerator is mated with a waste heat recovery system.

SUMMARY OF THE INVENTION

Accordingly, it is the object of this invention to provide an underfire system for a controlled starved-air incinerator and incinerating process which minimizes high localized temperatures in the main combustion chamber to lessen clinker formation and vaporization of inorganics for minimizing particulate emission and which maximizes conversion of the fixed carbon portion of the waste materials into volatile matter for maximizing the thermal efficiency of the incinerator.

By this invention, it has been found that the above object may be accomplished by providing an underfire system and incinerating process, as follows.

Air is supplied to the initially burning waste materials in the main combustion chamber at less-than-stoichiometric requirements for complete combustion which creates an exothermic reaction between some of the fixed carbon in the waste material and the oxygen in the air to produce volatile carbon dioxide. In addition, steam is supplied to the burning waste materials for creating an endothermic "water-gas reaction" between additional fixed carbon in the waste materials and the steam to produce volatile carbon monoxide and hydrogen gas and for absorbing undesired heat from the exothermic reaction.

With the above-described reactions, localized high temperatures in the main combustion chamber are controlled and minimized by the endothermic reaction absorbing heat from the exothermic reaction, so as to lessen clinker formation and vaporization of inorganics to minimize the particulate emission from the incinerator. Also, conversion of the fixed carbon portion of the waste materials into volatile matter is maximized by additional conversion through the "water-gas reaction" for complete combustion in the secondary combustion chamber thereby maximizing the thermal efficiency of the incinerator and reducing the amount of combustible matter passing out of the incinerator in the inert residue or ash.

The so-called "water-gas reaction", consisting of converting amorphous carbon to carbon monoxide and hydrogen gas by contacting a hot carbon bed with steam, has been known for many years. This reaction and apparatus utilizing same have been developed particularly in the field of the manufacture of low Btu fuel gas from coke. However, it is believed that this reaction has never been applied in a controlled starved-air incinerator or waste material incinerating process and, certainly, not in an underfire system which provides both air and steam to the burning waste materials for the purposes and to obtain the advantages described above.

BRIEF DESCRIPTION OF THE DRAWINGS

While some of the objects and advantages of this invention have been stated, other objects and advantages will appear as the description proceeds, when taken in conjunction with the accompanying drawings, in which.

DETAILED DESCRIPTION OF THE INVENTION

Figure 1:
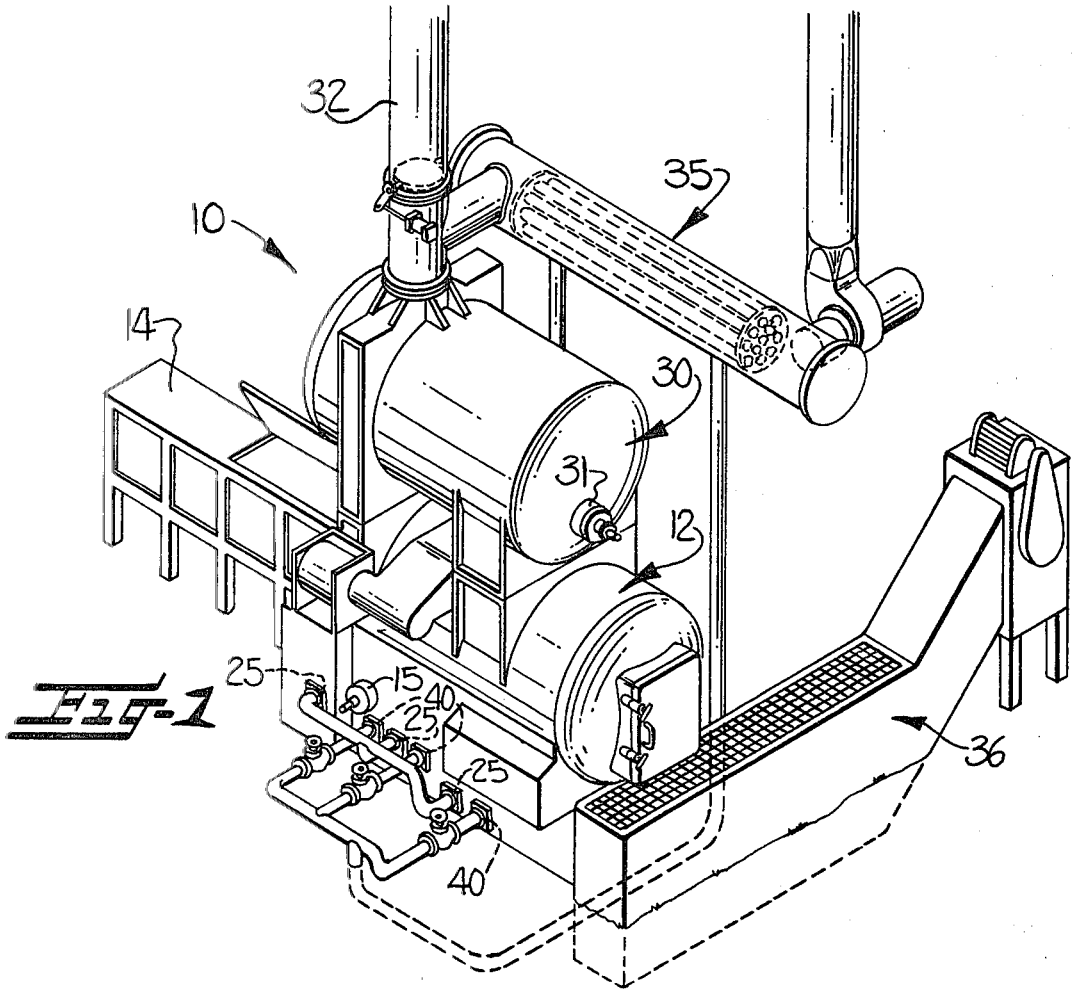
FIG. 1 is a perspective view of a controlled starved-air incinerator constructed in accordance with this invention.
Figure 2:
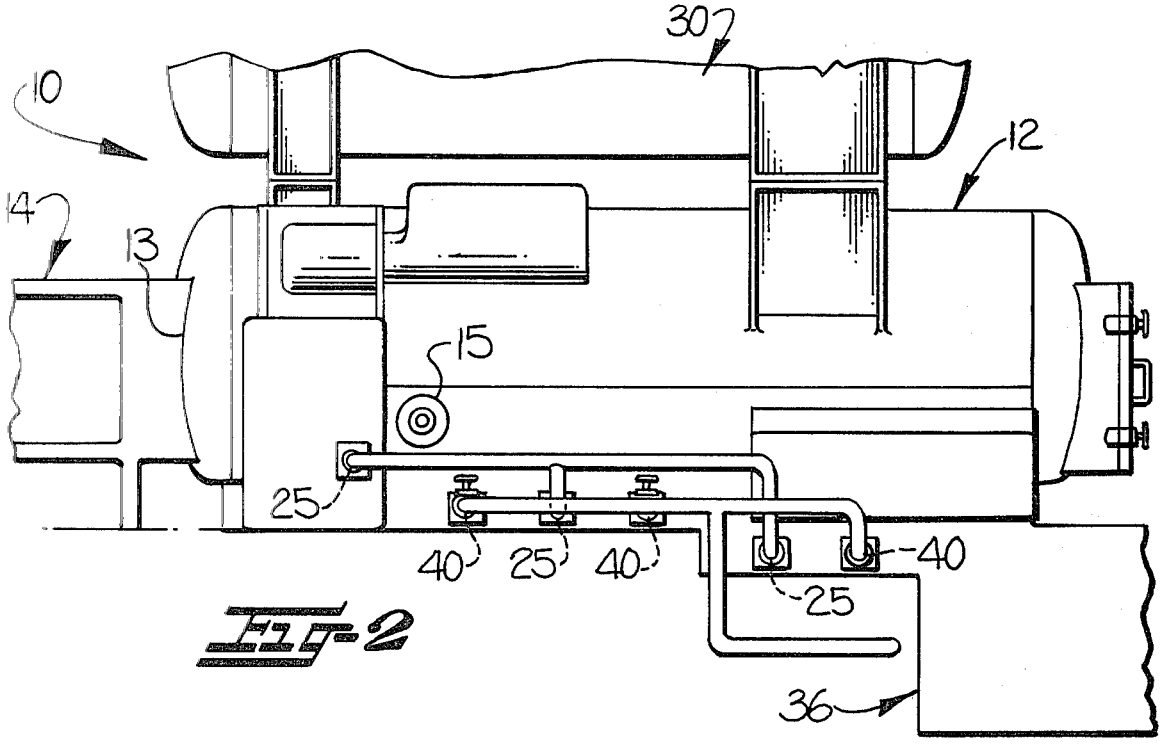
FIG. 2 is an enlarged, elevational view of a portion of the incinerator illustrated in FIG. 1.
Figure 3:
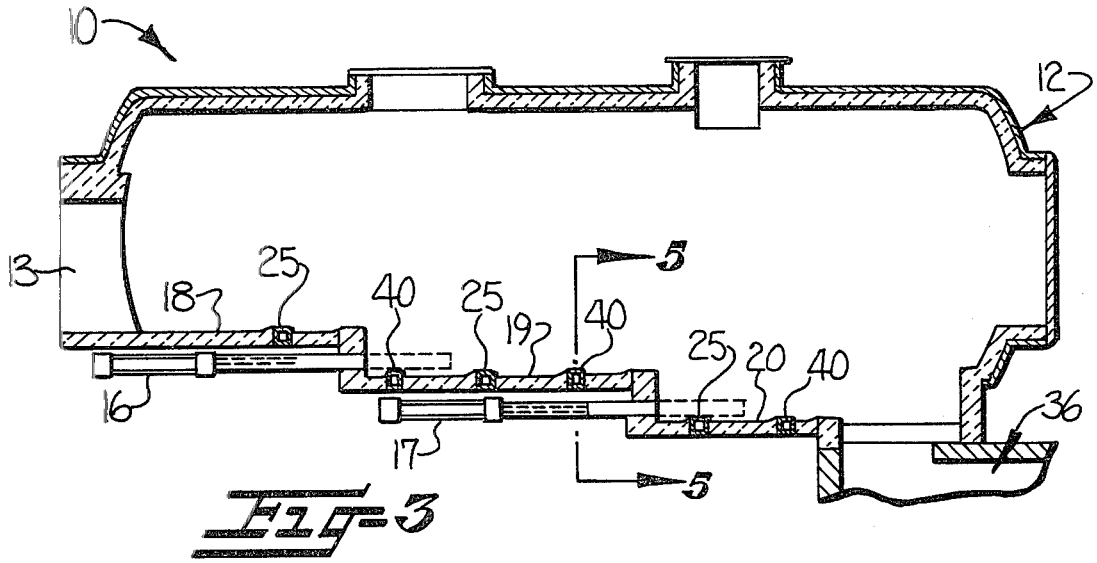
FIG. 3 is an enlarged sectional, elevational view through the main combustion chamber of the incinerator of FIG. 1.
Figure 4:
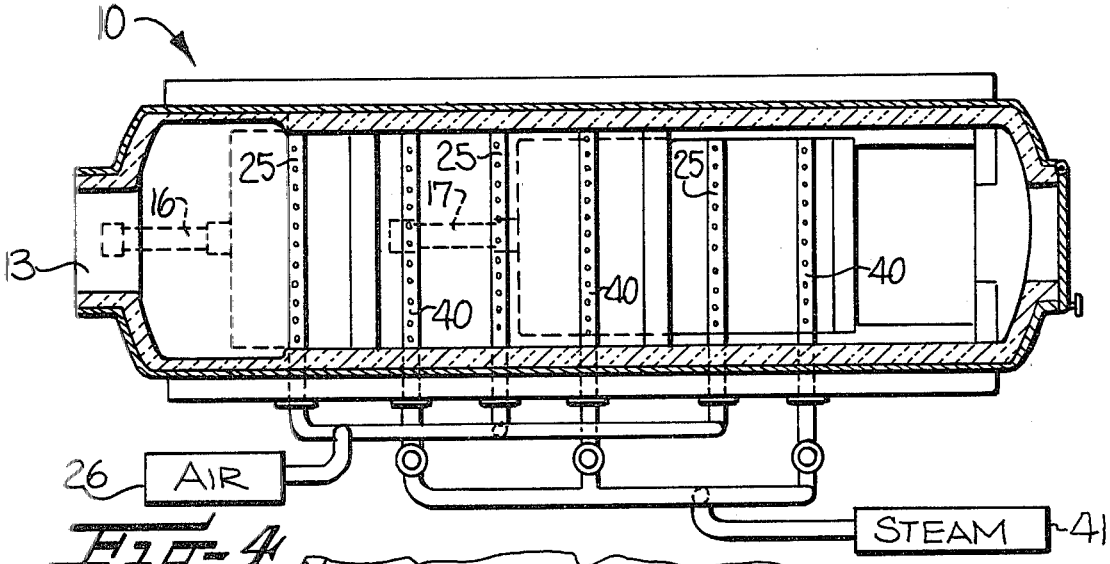
FIG. 4 is an enlarged sectional, plan view through the main combustion chamber of the incinerator of FIG. 1.
Figure 5:
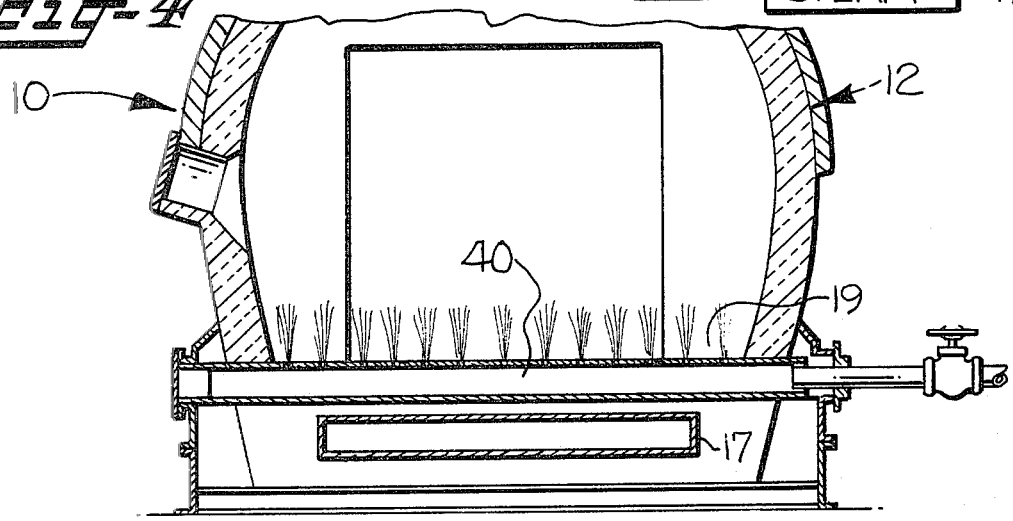
FIG. 5 is an enlarged, sectional view, taken generally along the line 5—5 of FIG. 3 and illustrating particularly one of the steam manifolds in the underfire air and steam system.

Referring now to the drawings, there is illustrated one embodiment of a controlled starved-air incinerator, generally indicated at 10, which incorporates the features of this invention therein and which may be utilized to practice the process of this invention. However, it is to be understood that other constructions of controlled starved-air incinerators may incorporate the novel features of this invention and may be utilized to practice the process of this invention.

In conventional controlled starved-air incinerators, a main combustion chamber 12 receives waste material W to be incinerated through an access opening 13. The waste material W may be fed into the main combustion chamber 12 through the access opening 13 by a conventional ram feed mechanism 14 or otherwise. Upon entry of the waste material W into the main combustion chamber 12, a burner 15 may be utilized to initially ignite the waste material W for burning in the main combustion chamber 12.

The main combustion chamber 12 is preferably an elongate or longitudinally-extending chamber and feeding means in the form of ram devices 16, 17 may be utilized for feeding the burning waste materials longitudinally through the main combustion chamber. As illustrated in the drawings herein, the main combustion chamber includes a multi-level hearth 18, 19, 20 so that the ram feeding mechanisms 14, 16, 17 may act to feed the burning waste material W longitudinally through the main combustion chamber 12 of the incinerator 10, as shown schematically in FIG. 6. These ram feeding devices 14, 16, 17 may be any type of hydraulic ram mechanisms, as schematically illustrated in the drawings, the construction of which is well known to those with ordinary skill in this art.

For supporting combustion in the main combustion chamber 12, an underfire system has been conventionally utilized which may include manifolds 25 for supplying air from a source 26 under the burning waste materials W at a rate less-than-stoichiometric requirements or theoretical air required for complete combustion of the waste materials W, which results in a very slow burning of the waste materials W at low temperatures in the main combustion chamber 12.

As set forth above, most waste materials W which would be incinerated can be basically described as being composed primarily of (1) volatile matter, (2) moisture, (3) fixed carbon and (4) non-combustibles (ash or inert residue). The initial slow burning of this waste material W at the low temperatures under less-than-stoichiometric requirements for the waste materials in the main combustion chamber 12 acts like distillation for vaporizing the volatile matter and the moisture in the waste materials W and to convert some of the fixed carbon of the waste materials to vaporized volatile matters.

Figure 6:
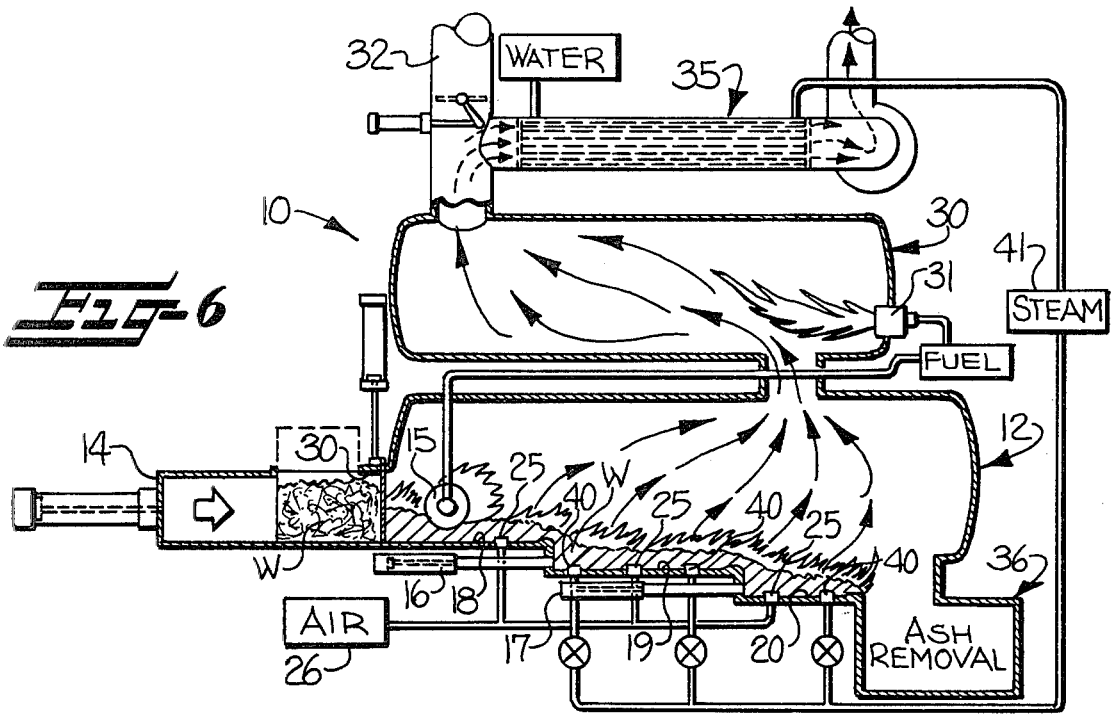
FIG. 6 is a schematic view illustrating the incinerating process of this invention.

These vaporized volatile materials, as shown schematically in FIG. 6, then pass to a secondary combustion chamber 30 where they are burned through the use of a burner 31 which also provides excess air at greater-than-stoichiometric conditions for complete combustion in the secondary combustion chamber 30 to effect substantially complete combustion of the vapors and conversion to organic materials for emitting to the atmosphere through a stack 32.

If desired, a waste heat recovery system in the form of a steam boiler 35 may be connected with the stack 32 for receiving some or all of the hot combustion gases from the secondary combustion chamber 30 to produce steam and recover heat produced by the incinerator 10. Such waste heat recovery systems mated with controlled starved-air incinerators are conventional and further detailed descriptions thereof are not necessary.

The non-combustible inert residue from the main combustion chamber 12 which is not converted to volatile vapors, may be removed by an ash removal system 36. The construction and operation of such ash removal system may be of conventional construction.

As discussed above, the slow burning of the waste material W at low tempertures under less-than-stoichiometric requirements in the main combustion chamber 12 is necessary to reduce turbulence, which would be created during a fast burning at high temperatures. This minimizes noncombustible particles or ash from passing with the vapors into the secondary combustion chamber 30 and prevents vaporization of some of the inorganic substances in the noncombustibles, which may result in stack opacity problems and particulate emissions from the incinerator 10 which are higher than permissible under many current state and federal environmental laws. Also, slow burning of the waste materials W at low temperatures under less-than-stoichiometric requirements in the main combustion chamber 12 is desirable for lessening clinker formation from ash fusion and melting of certain inorganic materials, such as low melting point metals, glass, etc., which are undesirable and which may cause problems in the ash removal system 36.

However, this slow burning at less-than-stoichiometric requirements for the waste materials W is recognized as failing to convert the maximum amount of the fixed carbon in the waste materials W to volatile vapors and such unconverted fixed carbons usually exit the incinerator 10 as partially burned char in the non-combustible inert residue or ash. Moreover, the incomplete combustion of these fixed carbons in the waste materials W results in a loss of overall thermal efficiency of the incinerator 10 which becomes of significant importance with the use of the waste heat recovery steam boiler 35.

Accordingly, in accordance with this invention, the underfire system for the main combustion chamber 12 of the incinerator 10 also includes manifolds 40 for supplying steam under the burning waste materials W as they are fed through the main combustion chamber 12. These manifolds 40 are connected to any suitable source of steam 41. The supplying of steam to the burning waste materials creates a "water-gas reaction" which cooperates with the reactions created by the underfire air to overcome the problems discussed above and to provide the advantages discussed above. A better understanding of these advantages may be had by examining the chemistry involved.

The major reaction occurring in the vicinity of the underfire air manifolds 25 is conversion of some of the fixed carbon of the waste materials W to carbon dioxide upon contact of the oxygen contained in the air and the fixed carbons, as follows:

$$C(solid)+O_2(gas)=CO_2(gas)$$

This reaction is exothermic, i.e. approximately 174,000 Btu are liberated for each pound mole (12 lbs.) of carbon reacted.

In the vicinity of the steam manifolds 40, the "water-gas reaction" proceeds according to the following equation when solid carbon is reacted with steam:

$$C(solid)+H_2O(gas)=CO(gas)+H_2(gas)$$

This reaction is endothermic, i.e. it absorbs heat to the extent of approximately 54,000 Btu/pound mole (12 lbs.) of carbon reacted.

The advantage of utilizing both of the above reactions in the main combustion chamber 12 can now be readily seen. Both reactions accomplish the same objective, i.e. conversion of solid carbon in the main combustion chamber 12 to carbon dioxide or conversion of the solid carbon to volatile carbon monoxide and hydrogen vapors which can undergo final combustion in the secondary combustion chamber 30.

With these combined reactions, localized high temperatures during burning in the main combustion chamber 12 are minimized through absorbing undesired heat from the exothermic reaction by the endothermic reaction to lessen clinker formation and vaporization of the noncombustibles which minimizes the particulate emission rate from the incinerator. Inasmuch as additional fixed carbon is converted to vaporized volatile matter, the thermal efficiency of the incinerator is increased.

Figure 7:
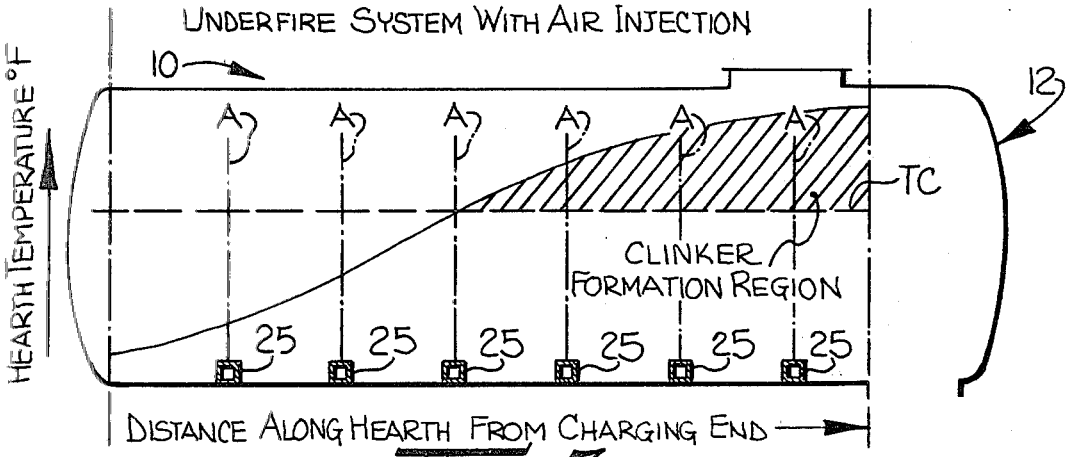
FIG. 7 is a temperature chart illustrating hearth temperatures along the main combustion chamber where an underfire system with air injection only is utilized.
Figure 8:
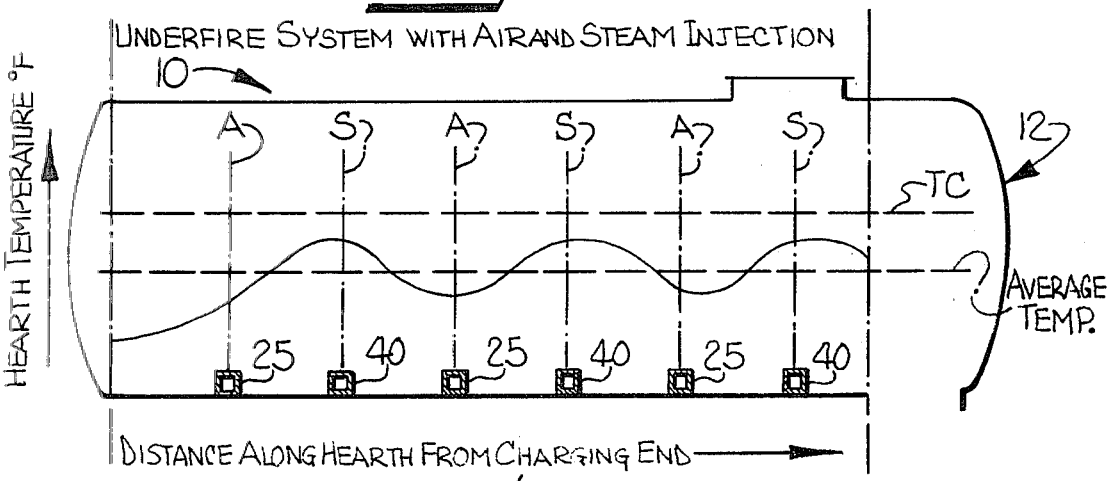
FIG. 8 is a temperature chart, like FIG. 7, illustrating hearth temperatures along the main combustion chamber where the underfire system utilizes both air and steam injection in accordance with this invention.

Referring now to FIGS. 7 and 8, FIG. 7 illustrates a typical temperature curve which would be obtained with an underfire system in the main combustion chamber of an incinerator 10 which injects air alone. The temperature line TC is typical of the temperature at which undesirable clinker formation and the other undesirable properties discussed above would begin. As may be clearly seen, the hearth temperature increases as the waste materials W are fed through the main combustion chamber to temperatures above the TC line. Conversely, as shown in FIG. 8 with the alternate injection of air and steam by the underfire system, the hearth temperature line remains below the line TC so as to avoid these problems.

For incinerating typical municipal wastes, it has been determined that if steam is supplied at a rate of at least 24 pounds/hour/ton of waste burned, an average hearth temperature will be maintained in the main combustion chamber 12 below about 2000° F., which is the temperature at which excessive clinker formation begins.

A further refinement of the underfire system in the main combustion chamber 12 in accordance with this invention is in the orientation of the air and steam manifolds 25, 40. In conventional controlled starved-air incinerators, the underfire air is introduced into the main combustion chamber through two or more longitudinally extending manifolds. This orientation of the underfire air supply manifolds enhances the problem of localized high temperatures as the waste materials W are fed longitudinally along such manifolds. In accordance with this invention, both the air supply and steam supply manifolds 25, 40 are oriented transversely of the path of travel of the burning waste materials W and of the main combustion chamber 12, so as to effect a more intimate mixing of underfire air and steam with the bulk of the burning waste materials W. This orientation also provides for introducing air and steam alternately at predetermined positions as the burning waste materials W are fed through the main combustion chamber 12 for obtaining maximum advantage of the above-discussed reactions.

The following sample calculations will further illustrate the advantages and the increased thermal efficiency of the incinerating process of this invention:

Assume a mixed municipal waste having a proximate analysis as follows:

| | | |
|---|---|---|
| Moisture | 25% | (by weight) |
| Volatile Matter | 40% | |
| Fixed Carbon | 10% | |
| Non-Combustibles | 25% | |
| | 100% | |

In controlled air incinerators, it is customary to find anywhere from 4% to 8% of the total ash to consist of fixed carbon (unburned carbon). Assuming a value of 6%, this would mean that for every one-ton per hour of raw waste fed to the incinerator, the total ash (including residual fixed carbon) exiting from the incinerator would be, $$\text{Total Ash} = \frac{2{,}000\ \#/\text{Hr} \times 0.25}{0.94} = 532\ \#/\text{Hr}$$

of the above amount, the fixed carbon content would be $0.06\times532=32\#/\text{Hr}$.

In the case of a heat recovery system, this 32#/Hr of fixed carbon represents a thermal loss in the overall system efficiency because, had the carbon been completely burned, an additional heat value equivalent to $32\#/\text{Hr}\times14{,}000$ Btu/#, or, 451,200 Btu/Hr would be available to the wate heat recovery system.

Now, assume steam is introduced to convert 50% of the residual carbon to volatile gases that can be combusted in the upper chamber according to the following chemical equations:

$$\underset{(12\#)}{C} + \underset{(18\#)}{H_2O\,(g)} = \underset{(28\#)}{CO} + \underset{(2\#)}{H_2} \quad \text{(endothermic Absorbs 4,500 Btu/\#C)} \tag{1}$$

The above reaction occurs in the lower chamber. The products of the above reaction, namely, CO and $H_2$ pass into the upper combustion chamber whereby they are mixed with air (oxygen) and undergo final combustion with heat liberation according to the following two chemical reactions:

$$\underset{(28\#)}{CO} + \underset{(16\#)}{\tfrac{1}{2}O_2} = \underset{(44\#)}{CO_2} \quad \text{(exothermic liberates 4,368 Btu/\#CO)} \tag{2}$$

$$\underset{(2\#)}{H_2} + \underset{(16\#)}{\tfrac{1}{2}O_2} = \underset{(18\#)}{H_2O} \quad \text{(exothermic liberates 61,084 Btu/\#H)} \tag{3}$$

The net effects of converting 50%, say, of the total 32#/Hr, or 16#/Hr of carbon to $CO_2$ and $H_2O$ by the water-gas reactions as outlined above are as follows:

Heat absorbed by reaction (1) $= 16\#C \times 4{,}500 \frac{Btu}{\#C} = 72{,}000$ Btu Heat liberated by reaction (2) $= 16\#C \times \frac{28\#CO}{12\#C} \times 4{,}368 \frac{Btu}{\#CO} =$ 163,072 Btu Heat liberated by reaction (3) $= 16\#C \times \frac{2\#H}{12\#C} \times 61{,}084 \frac{Btu}{\#H} =$ 162,890 Btu Net Heat Liberated = +163,072 Btu
+162,890
− 72,000
= +253,962 Btu # steam required for the above conversion of 16#C to $CO_2$ & $H_2O$ =

$$16\#C \times \frac{18\#H_2O}{12\#C} = 24\# \text{ steam}$$

Net heat required to produce above steam = 24 × 1,000 = 24,000 Btu.
Net heat liberated to system = +253,962 − 24,000 = 229,962 Btu.

Case I: One (1) ton/Hr waste without steam injection, i.e. 6% fixed carbon loss in ash.
Theoretical Heat Release $= 2{,}000 \times 4{,}500 \frac{Btu}{\#} = 9{,}000{,}000$ Btu/Hr.

Loss Due to Unburned

Carbon $= 32\#/Hr \times 14{,}000 \frac{Btu}{\#} = \underline{451{,}200}$

NET HEAT RELEASE = 8,548,800 Btu/Hr.

Case II: One (1) ton/Hr waste with steam injection, i.e. convert 50% of the potential heat loss of the fixed carbon to useful heat.
Theoretical Heat Release $= 2{,}000 \times 4{,}500 \frac{Btu}{\#} = 9{,}000{,}000$ Btu/Hr Loss Due to Unburned -continued Carbon $= 16\#/Hr \times 14{,}100 \frac{Btu}{\#} = \underline{225{,}600}$ Sub-Total 8,774,400 Btu/Hr Additional Heating Value by Conversion of 3% (or 16# carbon) of Fixed Carbon to Combustible Volatiles by the Water-Gas Reaction = 229,962 Btu/Hr Net Heat Release = 8,774,400 + 229,962
= 9,004,362 Btu/Hr % Improvement in Thermal Efficiency of Case II over Case I $= \frac{9{,}004{,}362}{8{,}548{,}800} = 1.05$
or +5%

In the drawings and specification, there has been set forth a preferred embodiment of the invention and although specific terms are employed, they are used in a generic and descriptive sense only and not for purposes of limitation.

What is claimed is:

1. A controlled starved-air incinerator for incinerating a wide variety of waste materials characterized by minimized particulate emissions and clinker formation and by increased thermal efficiency, said incinerator comprising:

an elongate horizontally-extending main combustion chamber for receiving waste materials at an entrance end and burning the waste materials at low temperatures to generate vaporized volatile matter;

means for progressively feeding the waste materials from the entrance end horizontally through said main combustion chamber while the waste materials are being burned;

an underfire system in said main combustion chamber for supporting combustion and comprising means for supplying air under the burning waste materials at a plurality of predetermined longitudinally spaced-apart locations along the length of said main combustion chamber and at less-than-stoichiometric requirements for creating exothermic reactions between some of the fixed carbon in the waste materials and the oxygen in the air to produce volatile carbon dioxide vapors, and means for supplying steam under the burning waste materials at a plurality of other predetermined longitudinally spaced-apart locations along the length of said main combustion chamber and alternating with the locations of said means for supplying air and for creating endothermic "water-gas" reactions between additional fixed carbon in the waste materials and the steam to produce volatile carbon monoxide and hydrogen vapors and for absorbing undesired heat from the exothermic reactions along the length of said main combustion chamber; and a secondary combustion chamber for receiving and finally burning the volatile vapors from the main combustion chamber and operating at greater-than-stoichiometric conditions to effect complete combustion; whereby, high localized temperatures along the length of said main combustion chamber are minimized so as to lessen clinker formation and vaporization of inorganics for minimizing the particulate emissions from said incinerator, and conversion of the fixed carbon portion of the waste materials into volatile matter is maximized for increasing the thermal efficiency of said incinerator.

2. A controlled starved-air incinerator, as set forth in claim 1, in which said means for supplying air and said means for supplying steam comprise separate spaced-apart manifolds extending transversely across said main combustion chamber and having exit ports therealong to provide intimate mixing of underfire air and steam with the bulk of the burning waste materials.

* * * * *